United States Patent [19]

Fox et al.

[11] Patent Number: 5,036,580

[45] Date of Patent: Aug. 6, 1991

[54] PROCESS FOR MANUFACTURING A POLYMERIC ENCAPSULATED TRANSFORMER

[75] Inventors: Lloyd Fox, North East, Md.; M. Lana Sheer, Kennett Square, Pa.

[73] Assignee: E. I. Du Pont de Nemours and Company, Wilmington, Del.

[21] Appl. No.: 586,172

[22] Filed: Sep. 21, 1990

Related U.S. Application Data

[63] Continuation-in-part of Ser. No. 493,585, Mar. 14, 1990, abandoned.

[51] Int. Cl.[5] ..... H01F 41/12

[52] U.S. Cl. ..... 29/605; 29/606; 29/607; 336/96; 264/272.19

[58] Field of Search ..... 29/605, 606, 609; 264/272.19, 272.13; 336/96

[56] References Cited

U.S. PATENT DOCUMENTS 4,632,798 12/1986 Eickman et al. ..... 264/272.17

4,944,975 7/1990 Sheer ..... 428/36.1

*Primary Examiner*—Carl E. Hall

[57] ABSTRACT

A process for manufacturing a polymeric encapsulated "E" core transformer, a polymeric encapsulated "C" core transformer, and a polymeric encapsulated toroidal shaped transformer, said process requiring considerably less time to complete than do conventional transformer manufacturing processes.

13 Claims, 2 Drawing Sheets

PROCESS FOR MANUFACTURING A POLYMERIC ENCAPSULATED TRANSFORMER

BACKGROUND

This application is a continuation-in-part of co-pending U.S. patent application Ser. No. 493,585, filed Mar. 14, 1990, now abandoned.

TECHNICAL FIELD

The present invention relates to a novel and efficient process for manufacturing a transformer that is encapsulated with an electrical insulating resin and encapsulated with a thermally conductive material, the purpose of which is to improve heat dissipation properties. The process of the present invention more specifically relates to a process for manufacturing a polymeric encapsulated transformer having an "E" shaped core, a polymeric encapsulated transformer having an "E" shaped core, a polymeric encapsulated transformer having a "C" shaped core, and a polymeric encapsulated transformer having a toroidal shaped core. Each such polymeric encapsulated transformer may be single phase or multi-phase, where "multi-phase" means two or more phases. The term "phase" is well known to those skilled in the art to mean the succession of electrical impulses of an alternating current in an electrical device.

The process of the present invention results in a polymeric encapsulated transformer that is superior in terms of safety and performance to conventional transformers. The process of the present invention further is superior to conventional processes due to superior process efficiency, the end-result of which is that the process of the present invention requires considerably less time to complete than do other conventional processes for manufacturing a transformer.

DESCRIPTION OF RELATED ART

Co-pending commonly assigned U.S. application Ser. No. 07/251,783 discloses improved thermally conductive materials and, more particularly, it relates to a carbon fiber reinforced resin matrix that can be used as a strong, structurally stable thermally conductive material. These materials are used in the process of the present invention to encapsulate certain parts of the transformer.

U.S. Pat. No. 4,944,975 discloses electrical device coil forms and, more particularly, it relates to coil forms produced from fiber reinforced resin materials. Such coil forms are used in the process of the present invention.

Co-pending commonly assigned U.S. application Ser. No. 07/433,819 discloses encapsulated electrical and electronic devices and more particularly, it relates to electrical and electronic devices encapsulated with both an insulating material and a thermally conductive material.

While the preceding references relate to certain component parts used in the process of the present invention, and the last reference describes a polymeric encapsulated transformer, none of the references disclose the particular process of the present invention.

SUMMARY OF THE INVENTION

The present invention relates to novel and efficient processes for manufacturing polymeric encapsulated transformers. It specifically relates to a novel process for manufacturing a single or multi-phase polymeric encapsulated transformer having an "E" shaped core, a single or multi-phase polymeric encapsulated transformer having a "C" shaped core, and a single or multi-phase polymeric encapsulated transformer having a toroidal shaped core.

BRIEF DESCRIPTION OF THE DRAWINGS

FIG. 1A is a three-dimensional view of the double wall coil bobbin and FIG. 1B is a side view of the double wall coil bobbin. The double wall coil bobbin has an outer wall (10) and an inner wall (11).

FIG. 2A is a three dimensional view of the single wall, single flanged coil bobbin and FIG. 2B is a side view of the single wall, single flanged coil bobbin. The single wall is indicated by 12 and the flange is indicated by 13.

DETAILED DESCRIPTION OF THE INVENTION

Figure 1A:
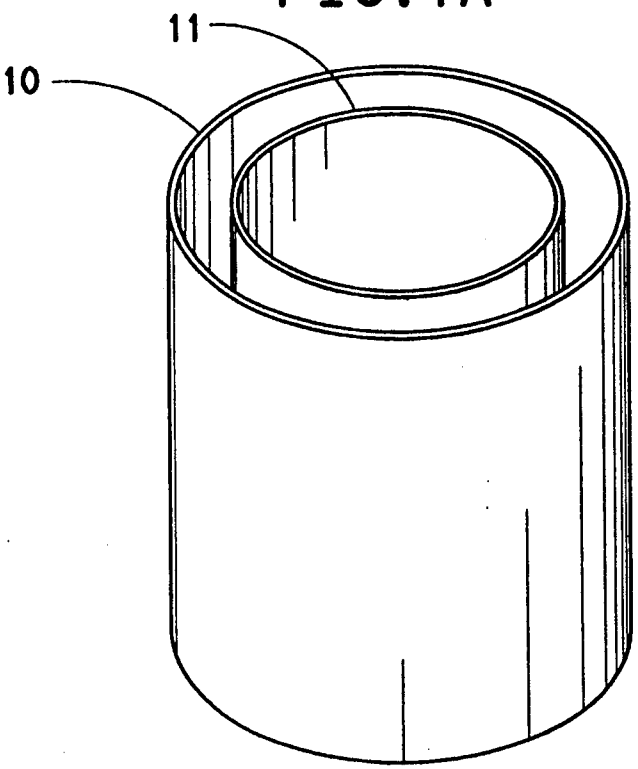
FIG. 1A and 1B are drawings of the double wall coil bobbin used in the process of the present invention.

The present invention relates to a novel and efficient process for manufacturing a polymeric encapsulated transformer. The present invention more specifically relates to processes for manufacturing a single or multi-phase polymeric encapsulated transformer having an "E" shaped core, a single or multi-phase polymeric encapsulated transformer having a "C" shaped core, and a single or multi-phase polymeric encapsulated transformer having a toroidal shaped core.

The concept of polymeric encapsulated transformers is a recent development in the art. Such transformers are deemed to be superior in terms of safety and performance in comparison to conventional, oil-based transformers. In the present invention, a process has been developed for manufacturing such polymeric encapsulated transformers and the process has been found to be much more efficient than the processes followed for the manufacture of conventional oil-based transformers.

One of the measures of efficiency for a process for manufacturing a transformer is the "in-process time" required to produce the transformer. "In-process time" is the actual net lapsed time required to produce a transformer and it is defined herein as the sum of the time required to complete each of the specific operations, or steps, of the process which are coupled together and must be performed sequentially to produce a transformer. "In-process time" does not include the time the components of the process are in storage racks. A reduction in "in-process time" is a pure measure of process efficiency, which translates into reductions in inventory costs and reductions in time required to manufacture a transformer. The "in-process time" required by the process of the present invention is, on average, approximately 800 minutes. In contrast, the "in-process time" required by conventional processes is, on average, 1800 minutes. Such a short time period can be attributed, in part, to the encapsulation steps used in the process of the present invention, said steps reducing significantly the time consuming heating steps used in conventional processes. Thus, the process of the present invention provides a faster, more efficient means by which to manufacture a polymeric encapsulated transformer than do those processes already known in the art.

The present invention relates to a process for manufacturing a single or multi-phase polymeric encapsulated transformer having an "E" shaped core, a single or multi-phase polymeric encapsulated transformer having a "C" shaped core, and a single or multi-phase polymeric encapsulated transformer having a toroidal shaped core. Regardless of the type and shape of transformer being produced, all processes involve some, if not all, of the following components: (1) laminates and stacked laminate structures, (2) coil forms, (3) electrical insulating material, (4) thermally conductive material, (5) double wall coil bobbin, (6) single wall, single flanged coil bobbin, (7) coil sleeve, and (8) thermoplastic wire holders and accessories. All processes further involve steps wherein electrical or electronic devices are encapsulated with either an electrical insulating material or a thermally conductive material. Each component is described below, as is the general technique for encapsulating electrical or electronic devices. Each individual process for manufacturing a particular transformer is described thereafter.

The first component listed above, i.e., the laminates and the stacked laminate structures, and useful herein are generally known in the art. Specifically, the term "laminate" as used herein refers to metal stampings made from grain oriented coils of silicon steel.

The laminates may be in different shapes, depending on the particular type of transformer being manufactured and the use of the laminates in the transformer. For transformers having an "E" shaped core, the laminates are in the shape of an "E" or are trapezoids bolted into the shape of an "E". For transformers having a "C" shaped core, the laminates are in the shape of a "C" or are trapezoids bolted into the shape of a "C". Laminates may also be rectangular in shape, which can be used as is or can be bolted into the shape of an "E" or a "C". For transformers having a toroidal shaped core, the laminates are in the shape of hollow cylinder wafers which, when stacked, form segments of a toroid. The stacked toroid segments, when fitted together, form a toroid.

The edges of a laminate are, due to stamping processes, considered "cut". It has been found that in the process described herein, the cut edges of the laminates may cause shorting of the laminates in the transformers during actual use. To prevent shorting of the laminates due to the cut edges, it is recommended that the cut edges of the laminates, if not encapsulated during transformer manufacturing process, be sealed with a non-conductive film. Examples of suitable non-conductive films include electrical grade polyethylene terephthalate film or electrical grade polyimide film.

The term "stacked laminate structure" as used herein means a structure made of individual laminates that are bolted, clamped, bonded, or otherwise bound together. The stacked laminate structure is an essential part of the transformer produced by the present process as it acts to transfer electricity from one set of wiring to another set of wiring in the polymeric encapsulated transformer.

The second component listed above and useful herein is a coil form. For transformers having a high temperature rise, such as, for example, 65° C., coil forms useful therein can be prepared from Dacron ®/Mylar ® insulation, Kraft ® paper, or engineering polymers such a polyesters or polyamides, either of which may or may not contain glass reinforcement or flame retardants.

The preferred coil form for transformers with either low or high temperature rise is described in U.S. Pat. No. 4,944,975 (hereinafter referred to as the '975 patent). More specifically, the coil form described in the '975 patent has high structural stability at a UL Standard 1446 rating of greater than 200° C. and comprises a structure of fiber reinforced resin matrix material having longitudinal passage there through. The outer peripheral surface of the structure forms a support for a wire coil wound thereon. Suitable materials which may be used as the resin matrix include electrically insulating thermoplastic or thermoset resins such as polyethylene terephthalate, 6,6-nylon, or electrical grade epoxy.

The resin of choice used for the coil form described in the '975 patent is reinforced with fibers such as, for example, glass and aramid fibers which may be continuous, long fiber, or discontinuous fiber, such as chopped or randomly broken, but in any event greater than ¼" in length. The fiber volumes preferably are in the range of from about 15% to about 70% and more preferably in the range of from about 20% to 50%. The coil forms described in the '975 patent can be made by any known process for making such forms as by braiding and filament winding of resin coated materials or by pultrusion methods or indeed by hand lay-up techniques well known in the art. Another preferred embodiment of the coil form described in the '975 patent is an aramid prepreg based on an electrically insulating resin.

The third component listed above and useful herein is an electrical insulating material. "Electrical insulating material" as used herein refers to thermoset or thermoplastic resins such as 6,6-polyamide, 12,12-polyamide, polybutylene terephthalate, polyphenylene sulfide, and polyethylene terephthalate, and glass reinforced versions of such resins. Optionally, such resins can contain flame retardant additives. The preferred electrical insulating material is a glass reinforced polyethylene terephthalate thermoplastic molding resin. It is further recommended that for best results, the electrical insulating material used in the process of the present invention be free from voids, conductive foreign materials, solvents, and other gases and liquids.

The fourth component listed above and useful herein is a thermally conductive material. "Thermally conductive material" as used herein refers composite materials made from a thermoset or thermoplastic resin and between about 5%–70%, preferably about 10%–70%, and most preferably about 15%–60% by weight of conductive materials, such as metallic flake (an example of which is aluminum), thermally conductive powder (examples of which include copper powder or sand), thermally conductive coke, or thermally conductive carbon fiber. Examples of suitable thermoset or thermoplastic resins include, but are not limited to, polyethylene terephthalate, polybutylene terephthalate, 6,6-polyamide, 12,12-polyamide, polypropylene, melt processible rubbers, such as partially cross-linked halogenated polyolefin alloys compounded with plasticizers and stabilizers (an example of which is Alcryn ®, manufactured by Du Pont), copolyetheresters (an example of which is Hytrel ®, manufactured by Du Pont), and polyphenylene sulfide. Polyethylene terephthalate is preferred. Ideally, the thermally conductive material is free of voids, foreign materials, solvents, and other gases and liquids. The thermally conductive material can be manufactured by techniques of extrusion and molding that are readily available to those skilled in the art.

The preferred thermally conductive material useful herein is disclosed in commonly assigned, co-pending U.S. patent application Ser. No. 07/251,783. More specifically, the preferred thermally conductive material useful herein is a composite material comprising 10% to 70% by weight carbon fiber and preferably about 15% to about 60% by weight carbon fiber, the balance of which can be made up of a resin or a combination of an alternate fiber or filler. The carbon fibers in the preferred thermally conductive material are preferably centrifugally spun from a mesophase pitch as disclosed in co-pending commonly owned U.S. patent application Ser. No. 092,217, filed Sept. 2, 1987, which is incorporated herein by reference. Preferably, the carbon fibers have a lamellar microstructure and a distribution of diameters ranging from about 1 micrometer to more than 10 micrometers and a number average less than 8 micrometers. The fibers are also heat treated in an inert atmosphere to a temperature above 1600° C., more preferably above 2400° C. Suitable resinous materials for the preferred thermally conductive material useful herein include thermoset or thermoplastic materials, such as, but not limited to, polyethylene terephthalate, polybutylene terephthalate, 6,6-polyamide, 12,12-polyamide, polypropylene, melt processible rubbers, such as partially cross-linked halogenated polyolefin alloys compounded with plasticizers and stabilizers (an example of which is Alcryn®, manufactured by Du Pont), copolyetheresters (an example of which is Hytrel®, manufactured by Du Pont), and polyphenylene sulfide. Polyethylene terephthalate is preferred. Ideally, the preferred thermally conductive material is free of voids, foreign materials, solvents, and other gasses and liquids.

The preferred thermally conductive material is a composite material made by feeding the resin and a carbon fiber batt made according to the disclosure in U.S. patent application Ser. No. 092,217 into a 2" single screw extruder and extruding the composite material as a strand which is then chopped and collected. The chopped strand is then used in various molding processes to form articles having high thermal conductivity. Thermal conductivity on the material can be measured in accordance with ASTM Standard F-433 with a Dynatech C-Matic instrument, model TCHM-DV.

The preferred thermally conductive material, which is a composite material, exhibits a three dimensional arrangement of fibers within the resin matrix as estimated from percent shrinkage data in the x, y, and z coordinate axes directions from mold size to the final part. More particularly, essentially equal percent shrinkage of the final part in the x, y, and z directions indicates three dimensional isotropic fiber reinforcement while percent shrinkage of the final part that varies by several orders of magnitude between directions suggests highly oriented reinforcing fibers.

Figure 1B:
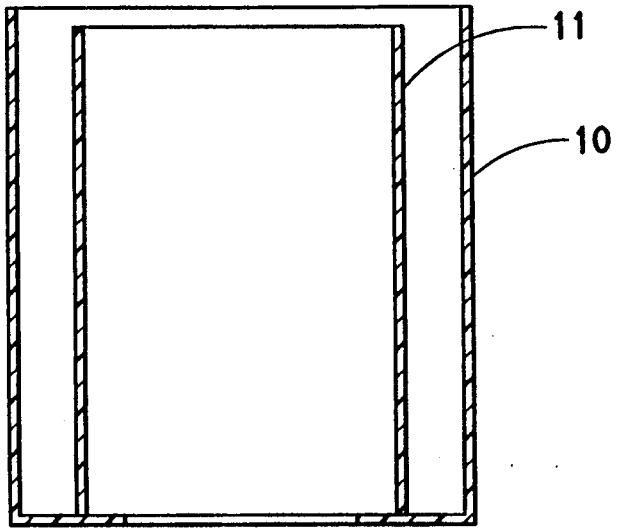

The fifth component listed above and useful herein is a double wall coil bobbin. The term "double wall coil bobbin" as used herein refers to a coil bobbin with a double wall. It is pictured in FIG. 1A (three-dimensional view) and FIG. 1B (side view). The double wall coil bobbin is molded from the electrical insulating material, described above as the third component. Preferably, the electrical insulating material used is glass reinforced polyethylene terephthalate. Optionally, it contains a flame retardant additive.

Figure 2A:
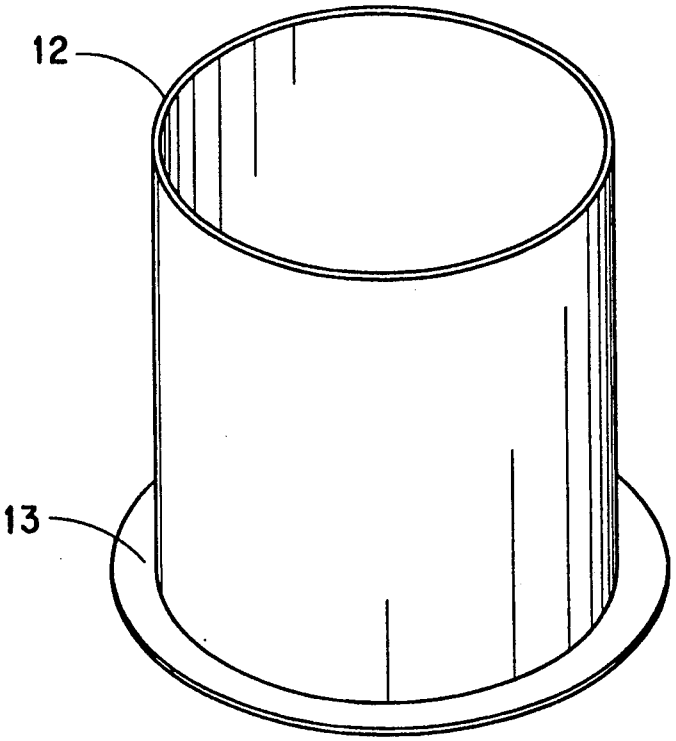
FIGS. 2A and 2B are drawings of the single wall, single flanged coil bobbin.
Figure 2B:
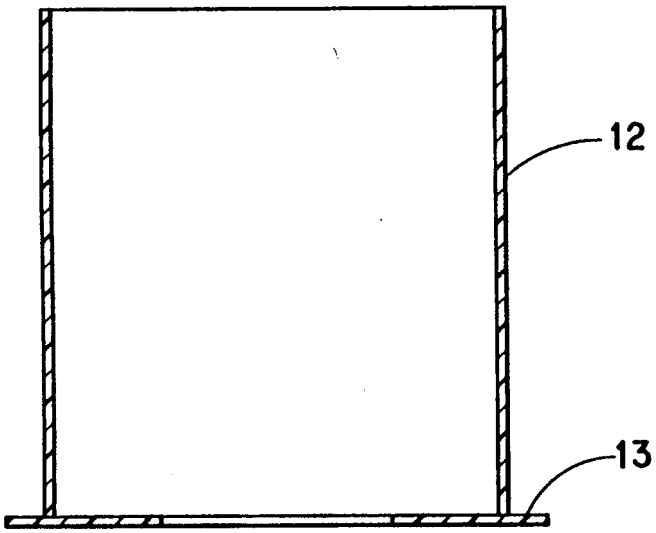

The sixth component listed above and useful herein is a single wall, single flanged coil bobbin. The term "single wall, single flanged coil bobbin" as used herein refers to a coil bobbin having one wall and one flange. Such structures are generally known in the art. The single wall, single flanged coil bobbin is depicted in FIG. 2A (three dimensional view) and FIG. 2B (side view). The single wall, single flanged coil bobbin is molded from the electrical insulating material, described above as the third component. Preferably, the electrical insulating material is glass reinforced polyethylene terephthalate. Optionally, this material contains a flame retardant additive.

The seventh component listed above and useful herein is a coil sleeve. The term "coil sleeve" as used herein refers to a sleeve molded from the electrical insulating material, described above as the third component, said sleeve being molded to fit over the single wall, single flanged coil bobbin described as the sixth component above. The coil sleeve is used in conjunction with the single wall, single flanged coil bobbin. The preferred electrical insulating material is glass reinforced polyethylene terephthalate. Optionally, this material contains a flame retardant additive.

The eighth component listed above and useful herein relates to thermoplastic wire holders and accessories. The term "accessories" refers to those components normally incorporated into a transformer, such as terminal boards, sockets, fuses, arrestors, mounting brackets, and devices for monitoring performance (examples of which include instruments and instrument probes). The accessories, in turn, may be encapsulated with any of the electrical insulating materials described above. The term "thermoplastic wire holders" refers to a device in which the wires of the transformers are held lengthwise along the device. More specifically, the thermoplastic wire holders are molded from a thermoplastic or thermoset resin, such as, for example, glass reinforced polyethylene terephthalate, into two halves, preferably rectangular in shape, wherein at least one of said two halves has an internal channel in the longitudinal direction throughout the halve. The wires for the transformer, along with the terminal blocks in the transformer, are placed along the internal channel, as described below for each individual process.

As stated above, in various steps of the process of the present invention, electrical or electronic devices are encapsulated with the electrical insulating material or the thermally conductive material. Techniques of encapsulating electrical and electronic devices are known as disclosed in Eickman et al. in U.S. Pat. No. 4,632,798. This reference also discloses that it is common practice to include, within the encapsulating resin, particulate filler material such as silica or alumina, which serves to increase thermal conductivity.

The processes for manufacturing polymeric encapsulated "E" core single and multi-phase transformers, polymeric encapsulated "C" core single and multi-phase phase transformers, and polymeric encapsulated toroidal single and multi-phase transformers from the components described above are described below.

I. PROCESS FOR MANUFACTURING A MULTI-PHASE TRANSFORMER HAVING AN "E" OR "C" SHAPED CORE

Multi-phase transformers having an "E" or "C" shaped core (and also referred to as "E" core transformers and "C" core transformers, respectively) are known to those skilled in the art. The present invention relates to a novel process for preparing a polymeric encapsulated multi-phase transformer having an "E" shaped or "C" shaped core.

Specifically, the process of the present invention for manufacturing a polymeric encapsulated multi-phase transformer having an "E" shaped or "C" shaped core consists essentially of the following steps:

(1) forming a stacked laminate structure from trapezoidal or rectangular shaped laminates having cut edges, sealing the cut edges of the laminates with a non-conductive film to prevent shorting of the laminates, and inserting the sealed stacked laminate structure into a coil form to form a laminate stacked coil form, (2) heat soaking the laminate stacked coil form to form a heat soaked laminate stacked coil form, (3) encapsulating the inside of the heat soaked laminate stacked coil form with a thermally conductive material to form an encapsulated laminate stacked coil form, (4) winding low voltage wires on the encapsulated laminate stacked coil form to form a low voltage encapsulated stacked coil form assembly, (5) inserting the low voltage encapsulated stacked coil form assembly into a molded double wall coil bobbin to form a low voltage double wall coil bobbin assembly, (6) winding high voltage wire in between the walls of the low voltage double wall coil bobbin assembly to form a high voltage-low voltage double wall coil bobbin assembly, (7) heat soaking the high voltage-low voltage double wall coil bobbin assembly to form a heat soaked high voltage-low voltage double wall coil bobbin assembly, (8) encapsulating the inside of the heat soaked high voltage-low voltage double wall coil bobbin assembly with an electrical insulating material to form an encapsulated high voltage-low voltage double wall coil bobbin assembly, (9) repeating step (1) through (8) above to form additional encapsulated high voltage-low voltage double wall coil bobbin assemblies,

(10) assembling the "E" or "C" shaped core of the multi-phase transformer assembly by (a) setting, for the "E" shaped core, at least three, preferably three, encapsulated high voltage-low voltage double wall coil bobbin assemblies in a perpendicular fashion on the ends and center of a stacked laminate structure formed from trapezoidal or rectangular laminates, thereby forming the "E" shape, or, for the "C" shaped core, setting two encapsulated high voltage-low voltage double wall coil bobbin assemblies in a perpendicular fashion on the ends of a stacked laminate structure formed from trapezoidal or rectangular laminates, thereby forming the "C" shape, (b) interleaving the stacked laminate structures at their joining points and securing said structures to the coil bobbin assemblies with a securing device, such as bolts or straps, (c) repeating steps (10)(a) and (10)(b) on the other end of the perpendicularly stacked encapsulated high voltage-low voltage double wall coil bobbin assemblies to form an "E" core or "C" core multi-phase transformer assembly, and (d) sealing any non-encapsulated cut edges of the laminates with non-conductive film,

(11) arranging the wiring in the "E" core or "C" core multi-phase transformer assembly in accordance with appropriate codes and standards,

(12) attaching accessories to the "E" core or "C" core multi-phase transformer assembly by standard techniques,

(13) enclosing the accessories and wires of the "E" core or "C" core multi-phase transformer assembly between two halves of a thermoplastic wire holder and then sealing the two halves of the thermoplastic wire holders together at the wire inlets and parting lines with a sealant,

(14) heat soaking the "E" core or "C" core multi-phase transformer assembly of step (13), and

(15) encapsulating the entire heat soaked "E" core or "C" core multi-phase transformer assembly from step 14 in a thermally conductive material to form a transformer that is encapsulated with an electrical insulating material and with a thermally conductive material.

The process of manufacturing the multi-phase transformer having the "E" shaped or "C" shaped core can then be "finished" by following standard procedures, such as manufacturing and assembling external terminals, attaching mounting brackets, and manufacturing mounting brackets.

Further detail on steps (1)-(15) above is provided below where necessary.

In step (1) of the process described in section I above, all cut edges of the laminates of the stacked laminate structure are sealed with a non-conductive film to prevent shorting of the laminates and then the sealed stacked laminate structure is inserted into a coil form to form a laminate stacked coil form.

In step (2) of the process described in section I above, the laminate stacked coil form is heat soaked. In the preferred heat soaking process, the laminate stacked coil form is heated in an oven for about 2 hours at a temperature of about 375° F. The heating operation prepares the laminate stacked coil form for the encapsulation process of step 3. In the absence of this heat soaking step, the laminate stacked coil form could become a heat sink, thereby removing heat from the encapsulation operation and causing too rapid cooling of the molding resin. The heat soak temperature can be from 300° F. to 450° F., with 375° F. being preferred. The heat soak time can be from 1 to 6 hours, preferably from 1 to 4 hours, and most preferably, about 2 hours. The time required for heat soaking is dependent upon the size of the laminate stacked coil form that is being heat soaked. The time required for heat soaking generally increases as the size of the coil form increases. At heat soaking times longer than 6 hours, process efficiency is decreased, even though such a long heating time is not expected to diminish the properties of the coil form.

In step (3) of the process described in section I above, the inside of the heat soaked laminate stacked coil form is encapsulated with a thermally conductive material to form an encapsulated laminate stacked coil form. Encapsulation techniques are previously referenced above.

In step (4) of the process described in section I above, low voltage wire is wound around the encapsulated laminate stacked coil form to form a low voltage encapsulated stacked coil form assembly. Standard techniques readily available to those skilled in the art may be used to wind the low voltage wire around the encapsulated laminate stacked coil form.

In step (5) of the process described in section I above, the low voltage encapsulated stacked coil form assembly of step (4) is inserted into a double wall coil bobbin to form a low voltage double wall coil bobbin assembly. The double wall coil bobbin serves as a container for randomly wound high voltage wiring (step (6)) or as a self-supporting high voltage coil (step (6)).

In step (6) of the process described in section I above, high voltage wire is randomly wound in between the walls of the low voltage double wall coil bobbin assembly to form a high voltage-low voltage double wall coil bobbin assembly. Alternatively, a self supporting coil of high voltage wire can be inserted between the walls of the double wall coil bobbin. Standard techniques readily available to those skilled in the art may be followed in the winding of the high voltage wire. To avoid corona discharge effects, high voltage coils are often potted in thermoset resins, such as electrical grade polyester or epoxy resins, and in some cases, such as those involving self supporting coils, the high voltage coils can be successfully potted in thermoplastic resins, such as those described for use in the thermally conductive materials, above.

An alternative method for forming the high voltage--low voltage double wall coil bobbin assembly useful in manufacturing multi-phase transformers having the "E" shaped or "C" shaped core is as follows: the low voltage encapsulated stacked coil form assembly of step (4) can be inserted into a single wall, single flanged coil bobbin to form a low voltage single wall, single flanged coil bobbin assembly. High voltage wire is then perfectly wound around said assembly by standard techniques readily available to those skilled in the art to form a high voltage-low voltage single wall, single flanged coil bobbin assembly. A coil sleeve is then placed over the high voltage-low voltage single wall, single flanged coil bobbin assembly, resulting in an assembly similar in geometry to that produced by step (6) with the double wall coil bobbin. The resultant product would be termed a high voltage-low voltage single wall coil form with coil sleeve. One would then proceed as directed in step (7).

In step (7) of the process described in section I above, the high voltage-low voltage double wall coil bobbin assembly of step (6) is heat soaked. The heat soaking process of step (7) is conducted for the same purpose as that of step (2); namely, it prepares the assembly for encapsulation in the electrical insulating material so that the molten electrical insulating conductive material will not cool too rapidly during the subsequent encapsulation process (step (8)). The heat soak temperature for this step should range from 300° F. to 400° F., with 350° F. to 375° F. being preferred. The heat soak time should be from 1.5 to 6 hours, preferably 1.5 to 4 hour, with 2 hours being most preferred. Again, as the size of the article being heat soaked increases, the time required for heat soaking also increases.

In step (8) of the process described above in section I, the inside of the heat soaked high voltage-low voltage double wall coil bobbin assembly of step (7) is encapsulated with an electrical insulating material. The purpose of encapsulating the inside of the assembly of step (7) with the electrical insulating material is to provide electrical insulation for the entire assembly of step (7) and to protect the components of said assembly from the effects of friction, wear, and thermal cycling.

At this point in the process, it is recommended that the encapsulated high voltage-low voltage double wall coil bobbin assembly of step (8) be tested by standard electrical tests, such as the megger test or the turn ratio test. In such tests, the wire terminals of the assembly are first subjected to very high voltage/low current (megger test) to detect electrical insulation faults that could cause short circuits in the operation of the completed transformer and then, an input voltage is imposed on either the low or high voltage side of the transformer. The output voltage is measured to assure that the turns of wire on the high and low voltage sides are correct and the transformer will produce the specified output voltage (turn ratio test).

In step (9) of the process described in section I above, steps (1) through (8) are repeated in order to form at least one more, preferably two more high, voltage-low voltage double wall coil bobbin assemblies. Two such assemblies would be used to form the "C" core while three or more such assemblies would be used to form the "E" core. These additional assemblies may be prepared simultaneously with the preparation of the first assembly or after the preparation of the first assembly. For economic reasons, three such assemblies are preferred. With three such assemblies in place, the transformer being produced would be a three phase (i.e., multi-phase) transformer.

In step (10) of the process described in section I above, the "E" core or "C" core multi-phase transformer assembly is prepared as described above.

In step (11) of the process described in section I above, the wiring in the "E" core or "C" core multi-phase transformer assembly is arranged. Generally, all the wires from the high and low voltage windings, plus any ground wires that must be included as appropriate and to insure compliance with codes and safety standards, will be connected to form a "Y" or Delta configuration, as specified in the transformer design. Additionally, the wires are arranged to satisfy appropriate codes and standards and to protect the transformer from accidental grounding or arcing.

In step (12) of the process described in section I above, accessories, such as terminal blocks, are attached to the "E" core or "C" core multi-phase transformer assembly as is standard in the trade.

In step (13) of the process described in section I above, the accessories, and specifically the terminal blocks, and wires are enclosed between the two halves of a thermoplastic wire holder, with the wires and terminal blocks resting throughout the internal channel of the thermoplastic wire holder. The two halves of the thermoplastic wire holders are clamped together as a clam shell around the wire ends and their terminal blocks. The wire holders are then sealed at the wire inlets and the parting lines with a sealant such as silicon to effect electrical insulation for the entire assembly, except at the terminal sockets. The terminal sockets are designed to accept external terminals which plug into the internal channel and establish electrical contact.

In step (14) of the process described in section I above, the "E" core or "C" core multi-phase transformer assembly of step (13) is heat soaked in order to prepare the assembly, which at this point has been singly encapsulated with an electrical insulating material, for encapsulation with a thermally conductive material. In this step, the heat soak temperature ranges from 300° F. to 400° F., with 375° F. being preferred. The heat soak time ranges from 1.5 hours to 6 hours, preferably 1.5 to 4 hours, with 2 hours being preferred. Again, the size of the article being heat soaked influences the time required for heat soaking.

In step (15) of the process described in section I above, the entire heat soaked "E" core or "C" core multi-phase transformer assembly of step (14) is encapsulated in a thermally conductive material. The thermally conductive material may be the same as that used in step (3) or it may be different. The purpose of this step is to provide thermal conduction for the entire assembly and to protect the components of the entire assembly from the environment and the effects of the environment, including corrosion, friction, wear, and thermal cycling. The resultant product is a transformer that is encapsulated with a first electrical insulating material and a second thermally conductive material.

The encapsulated transformer of step (15) can be "finished" by techniques readily available to those skilled in the art. By "finished", it is meant that the encapsulated transformer would be subjected to high potential tests, then the external terminals for the encapsulated transformer would be manufactured and assembled, then mounting brackets would be manufactured for and attached to the encapsulated transformer, and then the encapsulated transformer could be put into use or easily stored.

II. PROCESS OF MANUFACTURING A SINGLE PHASE TRANSFORMER HAVING AN "E" SHAPED CORE

Single phase transformers having an "E" shaped core (and also referred to as "E" core transformers) are known to those skilled in the art. The present invention relates to a novel process for preparing polymeric encapsulated "E" core single phase transformers.

Specifically, the process of the present invention for manufacturing a polymeric encapsulated "E" core single phase transformer consists essentially of the following steps:

(1) preparing a stacked laminate structure wherein the laminates are stamped in the shape of an "E" by standard techniques, wherein the "E" shaped laminate is said to have a center post and two end posts, and the edges of the laminates are considered "cut", (2) winding low voltage wire on a coil form by standard techniques to form a low-voltage coil form, (3) inserting the low-voltage coil form into a single wall, single flanged coil bobbin to form a low voltage coil bobbin assembly, (4) placing a coil sleeve over the low voltage coil bobbin assembly to form a low voltage coil bobbin-coil sleeve assembly, (5) winding high voltage wire around the outside of the coil sleeve of the low voltage coil bobbin-coil sleeve assembly by standard techniques to form a high voltage-low voltage coil bobbin-coil sleeve assembly, (6) heat soaking the high voltage-low voltage coil bobbin-coil sleeve assembly to form a heat soaked high voltage-low voltage coil bobbin-coil sleeve assembly, (7) encapsulating the inside of the heat soaked high voltage-low voltage coil bobbin-coil sleeve assembly with an electrical insulating material to form an insulated encapsulated high voltage-low voltage assembly, (8) placing the insulated encapsulated high voltage--low voltage assembly over one of the posts, preferably the center post, of the "E" shaped laminate stacked structure of step (1), (9) assembling a laminate stack structure from rectangular shaped laminates and bolting, bonding, strapping, or otherwise attaching the laminate stack structure to the posts of the "E" shaped laminate stack structure of step (8) in order to form an "E" core single phase transformer assembly,

(10) arranging the wiring in the "E" core single phase transformer assembly in accordance with appropriate codes and standards,

(11) attaching accessories to the "E" core single phase transformer assembly by standard techniques,

(12) enclosing the accessories and wires of the "E" core single phase transformer assembly between two halves of a thermoplastic wire holder, then sealing the two halves of the thermoplastic wire holders together at the wire inlets and parting lines with a sealant, and then sealing any unencapsulated cut edges of the laminates with a non-conductive film to prevent shorting of the laminates,

(13) heat soaking the "E" core single phase transformer assembly of step (12), and

(14) encapsulating the entire heat soaked "E" core single phase transformer assembly from step (13) with a thermally conductive material to form a transformer that is encapsulated with an electrical insulating material and with a thermally conductive material.

Heat soaking, as required in steps (6) and (13) of section II above, is done for the same purposes that such steps were done in section I above for the process for manufacturing the "E" core or "C" core multi-phase transformer described previously. In step (6), the heat soaking process is as follows: the low voltage-high voltage coil bobbin-coil sleeve assembly is heated in an oven for about 2 hours at a temperature about 375° F. The heat soak temperature can be from 300° F. to 450° F., with 375° F. being preferred. The heat soak time can be from 1 to 6 hours, preferably 1 to 4 hours, with 2 hours being most preferred. In step (13), the heat soaking process is as follows: the "E" core single phase transformer assembly of step (12) is heat soaked at temperatures ranging from 300° F. to 400° F., with 375° F. being preferred. The heat soak time ranges from 1.5 hours to 6 hours, preferably 1.5 to 4 hours, with 2 hours being most preferred. Again, the size of the article being heat soaked influences the time required for heat soaking.

The process of steps (10), (11), and (12) in section II for the "E" core single phase transformer process are conducted in a similar fashion as steps (11), (12), and (13), respectively, of section I for the "E" core or "C" core multi-phase transformer process.

The steps or procedures not specifically described for the process of this section II have been described above or are considered self-explanatory or can be completed by known and readily available techniques.

The process of manufacturing the "E" core single phase transformer can be "finished" by following standard procedures, such as manufacturing and assembling external terminals, attaching mounting brackets, and manufacturing mounting brackets.

The process for manufacturing the single phase transformer having an "E" shaped core can also be used to make a multi-phase transformer having an "E" shaped core. In such a case, additional, preferably two, insulated encapsulated high voltage-low voltage assemblies would be prepared by repeating steps (I)-(7) of the process for manufacturing the "E" core single phase transformer. Then, in addition to mounting one assembly on a post of the "E" shaped laminate stacked structure, as is detailed in the immediately preceding step (8), one assembly would be mounted on a second post of the "E" shaped laminate stacked structure. Preferably, one assembly is mounted on each end post, along with the center post, thereby forming a multi-phase transformer having three phases. To complete manufacture of the multi-phase transformer by this process, steps (9)-(14) and the "finishing" procedures described for the single phase "E" core transformer process, would be followed.

III. PROCESS OF MANUFACTURING A SINGLE OR MULTI-PHASE TRANSFORMER HAVING A "C" SHAPED CORE

Single or multi-phase transformers having a "C" shaped core (and also referred to as "C" core transformers and also sometimes referred to as "U" core transformers) are known to those skilled in the art. The present invention relates to a novel process for preparing polymeric encapsulated "C" core single or multi-phase transformers.

Specifically, the process of the present invention for manufacturing a polymeric encapsulated "C" core single or multi-phase transformer consists essentially of the following steps:

(1) (a) preparing a stacked laminate structure wherein the edges of the laminates are considered "cut" and the laminates are in the shape of a "C" by standard techniques, wherein the "C" is considered to have two posts, or, alternatively, (b) concentrically winding laminates to form a concentrically wound structure, cutting the concentrically wound structure into two "C" shapes, and wherein the edges of the "C" shaped concentrically wound structures are considered "cut", and, (c) in the case of either III(1)(a) or III(1)(b), sealing the cut edges of the stacked laminate or concentrically wound structure with a non-conductive film to prevent shorting of the laminates, (2) winding low voltage wire on a coil form by standard techniques to form a low voltage coil form, (3) inserting the low voltage coil form into a double wall coil bobbin to form a low voltage double wall coil bobbin assembly, (4) winding high voltage wire in between the walls of the double wall coil bobbin of the low voltage coil bobbin assembly to form a high voltage-low voltage double wall coil bobbin assembly, (5) heat soaking the high voltage-low voltage double wall coil bobbin assembly to form a heat soaked high voltage-low voltage coil bobbin assembly, (6) encapsulating the inside of the heat soaked high voltage-low voltage coil bobbin assembly with an electrical insulating material to form an encapsulated high voltage-low voltage coil bobbin assembly, (7) repeating the processes of steps (2) to (6) to form another high voltage-low voltage coil bobbin assembly, (8) mounting one encapsulated high voltage-low voltage coil bobbin assembly on one post of the stacked laminate or concentrically wound structure of step (1) and mounting the other high voltage-low voltage coil bobbin assembly on the other post of the stacked laminate or concentrically wound structure of step (1), (9) assembling a laminate stack structure from rectangular shaped laminates and bolting, bonding, strapping, or otherwise attaching the laminate stack structure to the posts of the "C" shaped laminate stack structure upon which was inserted the insulated encapsulated high voltage-low voltage assemblies to form a "C" core single or multi-phase transformer assembly,

(10) arranging the wiring in the "C" core single or multi-phase transformer assembly in accordance with appropriate codes and standards,

(11) attaching accessories to the "C" core single or multi-phase transformer assembly by standard techniques,

(12) enclosing the accessories and wires of the "C" core single or multi-phase transformer assembly between two halves of a thermoplastic wire holder and then sealing the two halves of the thermoplastic wire holders together at the wire inlets and parting lines with a sealant,

(13) heat soaking the "C" core single or multi-phase transformer assembly of step (12), and

(14) encapsulating the entire heat soaked "C" core single or multi-phase transformer assembly from step (13) in a thermally conductive material to form a transformer that is encapsulated with an electrical insulating material and with a thermally conductive material.

Heat soaking, as required in steps (5) and (13) of section III above, is done for the same purposes that such steps were done in the process for manufacturing the "E" core or "C" core transformer described previously in section I above. In step (5) of section III above, the heat soaking process is as follows: the low voltage-high voltage coil bobbin-coil sleeve assembly is heated in an oven for about 2 hours at a temperature of about 375° F. The heat soak temperature can be from 300° F. to 450° F., with 375° F. being preferred. The heat soak time can be from 1 to 6 hours, preferably from 1 to 4 hours, with 2 hours being most preferred. In step (13) of section III above, the heat soaking process is as follows: the "C" core single or multi-phase transformer assembly from step (12) is heat soaked at temperatures ranging from 300° F. to 400° F., with 375° F. being preferred. The heat soak time ranges from 1.5 hours to 6 hours, preferably 1.5 to 4 hours, with 2 hours being most preferred. Again, the heat soaking time required is influenced by the size of the article being heat soaked.

The steps or procedures not specifically described for the process of this section III have been described above or are considered self-explanatory or can be completed by known and readily available techniques.

The process of manufacturing the "C" core single or multi-phase transformer can be finished by following standard procedures, such as manufacturing and assembling external terminals, attaching mounting brackets, and manufacturing mounting brackets.

IV. PROCESS OF MANUFACTURING A SINGLE OR MULTI-PHASE TRANSFORMER HAVING A TOROIDAL SHAPED CORE

Transformers having toroidal shaped cores are known to those skilled in the art. The present invention relates to a novel process for preparing a polymeric encapsulated transformer having a toroidal shaped core.

Specifically, the process of the present invention for manufacturing a polymeric encapsulated transformer having a toroidal shaped core consists of the following steps:

(1) preparing circumferential segments of a toroidal shaped core by (a) preparing a stacked laminate structure wherein the laminates are stamped, by standard techniques, into the shape of hollow cylinder wafers and stacked together to form circumferential segments of a toroidal core and wherein the edges of the circumferential segments are considered "cut" or (b) convolute winding a metal ribbon into a toroid shape and then separating the resultant metal toroid into circumferential segments of a toroidal core wherein the edges of the circumferential segments are considered "cut", and (c) in the case of either IV(1)(a) or IV(1)(b), sealing the cut edges of the circumferential segments with a non-conductive film, (2) winding low voltage wire on a coil form by standard techniques to form a low voltage coil form assembly, (3) inserting the low voltage coil form assembly into a single wall, single flanged coil bobbin to form a low voltage coil bobbin assembly, (4) placing a coil sleeve over the low voltage coil bobbin assembly to form a low voltage coil bobbin-coil sleeve assembly, (5) winding high voltage wire around the outside of the coil sleeve of the low voltage coil bobbin-coil sleeve assembly by standard techniques to form a high voltage-low voltage coil bobbin-coil sleeve assembly, (6) heat soaking the high voltage-low voltage coil bobbin-coil sleeve assembly to form a heat soaked high voltage-low voltage coil bobbin-coil sleeve assembly, (7) encapsulating the inside of the heat soaked high voltage-low voltage coil bobbin-coil sleeve assembly with an electrically insulating material to form an insulated encapsulated high voltage-low voltage assembly, (8) placing one or more of the insulated encapsulated high voltage-low voltage assemblies over the circumferential segments of the toroidal core of step (1) to form assembled toroidal core segments, (9) bolting, bonding, strapping, or otherwise attaching the assembled toroidal core segments into a toroid to form a single or multi-phase toroidal transformer assembly,

(10) arranging the wiring in the single or multi-phase toroidal transformer assembly in accordance with appropriate codes or standards,

(11) attaching accessories to the single or multi-phase toroidal transformer assembly by standard techniques,

(12) enclosing the accessories and wires of the single or multi-phase toroidal transformer assembly between two halves of a thermoplastic wire holder and then sealing the two halves of the thermoplastic wire holder together at the wire inlets and parting lines with a sealant,

(13) heat soaking the single or multi-phase toroidal transformer assembly of step (12), and

(14) encapsulating the entire heat soaked single or multi-phase transformer assembly of step (13) in a thermally conductive material to form a transformer that is encapsulated with an electrical insulating material and with a thermally conductive material.

Heat soaking, as required in steps (6) and (13) of section IV, is done for the same purpose as such steps were done for the process for manufacturing the "E" core or "C" core transformers of section I, above. In step (6) of section IV, the heat soaking process is as follows: the high voltage-low voltage coil bobbin-coil sleeve assembly is heated in an oven for about 2 hours at a temperature of about 375° F. The heat soak temperature can be from about 300° F. to about 450° F., with about 375° F. being preferred. The heat soak time can be from 1 to 6 hours, preferably 1 to 4 hours, with 2 hours being most preferred. In step (13) of section IV, the heat soaking process is as follows: the toroidal transformer assembly of step (12) is heat soaked at temperatures ranging from about 300° F. to about 400° F., with 375° F. being most preferred. The heat soak time ranges from about 1.5 hours to 6 hours, with 2 hours being most preferred. Again, the size of the article being heat soaked influences the time required for heat soaking.

The process of steps (10), (11), and (12) of section IV for the manufacture of a polymeric encapsulated toroidal shaped transformer are conducted in a similar fashion as are steps (11), (12), and (13), respectively, of the process of section I, above, for the manufacture of "E" core or "C" core transformers.

The steps or procedures not specifically described for the process of section IV have been described above or are considered self-explanatory or can be completed by known and readily available techniques.

The process of manufacturing the toroidal core transformer can be "finished" by following standard procedures, such as manufacturing and assembling external terminals, manufacturing mounting brackets, and assembling mounting brackets.

EXAMPLES

1. SINGLE PHASE POLYMERIC ENCAPSULATED "E" CORE TRANSFORMER

A 0.060" thick coil form can be made from an EsSEE GFR structural composite (manufactured by Du Pont) in accordance with the disclosures in U.S. Pat. No. 4,944,975. Laminates would be manufactured from grain oriented coils of silicon steel. The laminates would be "E" shaped. Half of the "E" laminates would be stacked together to form a laminate stacked structure which would form the bottom "E" section of the transformer core. The other half of the laminates would be stacked together to form a laminate stacked structure and would be put aside for use in a later step. Low voltage wire would be wound on the coil form as follows: 133 turns of an epoxy coated low voltage wire, 0.085" square, in 4 layers would be wound over the coil form, with 10 mil thickness of Nomex® 410 paper being interleaved between the layers. This would form a low-voltage coil form assembly. A 0.060" wall thickness single walled, single flanged coil bobbin would be injection molded from a 30% glass reinforced polyethylene terephthalate. Also, a 0.040" thick coil sleeve would be injection molded from a 30% glass reinforced polyethylene terephthalate. The single walled, single flanged coil bobbin would be placed over the low voltage coil form assembly and high voltage wire would be wound over the single walled, single flanged coil bobbin assembly as follows: 266 turns of an epoxy coated, high voltage 16 gauge wire would be wound over the assembly in 6 layers with 10 mil Nomex® paper being interleaved between layers of the windings. The coil sleeve molded above would then be placed over the high voltage wound assembly and the assembly would then be heat soaked for 2 hours at 375° F.

After heat soaking the assembly, the entire assembly would be placed in steel tooling and the inside of the assembly would be encapsulated with a 30% glass reinforced polyethylene terephthalate resin. The tool temperature would be 350° F. to 400° F. during encapsulation and the melt temperature would range between 560° F. to 570° F. Cycle time would be approximately one minute. After encapsulation, the assembly would be tested for electrical continuity (megger test) and design performance (turns ratio). After electrical testing, the encapsulated assembly would be mounted on the center post of the "E" laminates. The remaining half of the "E" laminate structure formed above and set aside for later use would be interleaved with the "E" stacked laminate structure forming the bottom of the "E" core of the transformer and then the two stacked laminate structures would be bolted together, thus forming an "E" core single phase assembly.

The thermoplastic wire holders would be manufactured from 30% glass reinforced polyethylene terephthalate. The wiring of the "E" core single phase assembly would be arranged and connected in accordance with standard codes and specifications. The wire endings would be connected to leads and placed in the internal channels of the thermoplastic wire holders, which would then be sealed with a silicon based insulating adhesive.

The "E" core single phase assembly would then be heat soaked for two hours at 400° F. The heat soaked assembly would then be placed in a steel tooling and completely encapsulated in a thermally conductive polyethylene terephthalate, under the same molding conditions given above but with a cycle time of about 5 minutes. The encapsulated transformer assembly would then be cooled, electrically tested at high voltage, and finished under standard conditions.

2. SINGLE PHASE POLYMERIC ENCAPSULATED "C" CORE TRANSFORMER

A 0.060" thick coil form can be made from a EsSEE GFR structural composite (manufactured by Du Pont) in accordance with the disclosures in U.S. Pat. No. 4,944,975. Laminates would be manufactured from grain oriented coils of silicon steel in the shape of a "C". The coil forms will eventually be mounted on the "legs" of the "C". Half the "C" laminates would be stacked together to form a first stacked laminate structure. The other half of the "C" laminates would be stacked to form a second stacked laminate structure and would be reserved for interleaving with the first stacked laminate structure at a later time.

Around the coil form would be wound 133 turns of an epoxy coated low voltage wire, 0.085" square in 4 layers. Interleaved between the layers of windings would be Nomex ® paper, 10 mil thickness. This would form a low-voltage coil form assembly.

A double wall coil bobbin would be injection molded from glass reinforced polyethylene terephthalate. The low voltage coil form assembly would then be inserted into the double wall coil bobbin to form a low voltage double wall coil bobbin assembly. The low voltage double wall coil bobbin assembly would be heat soaked for two hours at 400° F. The heat soaked assembly would then be placed in a steel tooling and the inside would be encapsulated with a 30% glass reinforced polyethylene terephthalate. The melt temperature would be 560°-570° F., the tool temperature would be 350°-400° F., and the cycle time would be about one minute. The encapsulated low voltage assembly would then be tested for electrical continuity (megger test) and design performance (turn ratio).

After electrical testing, the encapsulated low voltage assembly would be mounted on one of the "legs" of the "C" stacked laminate structure. The entire procedure would be repeated to produce a second encapsulated low voltage assembly, which would then be mounted on the other "leg" of the "C" stacked laminate structure. The second stacked laminate structure prepared above and reserved for later use would then be interleaved with the first stacked laminate structure and the two structures would be bolted together, thus forming a "C" core single phase assembly.

Thermoplastic wire holders would be manufactured from 30% glass reinforced polyethylene terephthalate. The wiring of the "C" core single phase assembly would be arranged and connected in accordance with standard codes and specifications. The wire endings would be connected to leads and placed in the internal channels of the thermoplastic wire holders, which would then be sealed with a silicon based insulating adhesive.

The "C" core single phase assembly would then be heat soaked for two hours at 400° F. The entire heat soaked assembly would then be placed in a steel tooling and completely encapsulated in a thermally conductive polyethylene terephthalate, under the same molding conditions given above but with a cycle time of about 5 minutes. The encapsulated transformer assembly would then be cooled, electrically tested at high voltage, and finished under standard conditions.

What is claimed is:

1. A process for manufacturing a polymeric encapsulated multi-phase transformer having an "E" shaped core consisting essentially of the steps of (a) forming a stacked laminate structure from trapezoidal or rectangular shaped laminates, said laminates having cut edges, then sealing the cut edges of the stacked laminate structure with a non-conductive film to form a sealed stacked laminate structure, then inserting the sealed stacked laminate structure into a coil form to form a laminate stacked coil form, (b) heat soaking the laminate stacked coil form at 300° F. to 450° F. to form a heat soaked laminate stacked coil form, (c) encapsulating the inside of the heat soaked laminate stacked coil form with a thermally conductive material to form an encapsulated laminate stacked coil form, (d) forming a low voltage encapsulated stacked coil form by winding low voltage wires on the encapsulated laminate stacked coil form, (e) forming a high voltage-low voltage double wall coil bobbin assembly by (1) inserting the low voltage encapsulated stacked coil form assembly into a molded double wall coil bobbin to form a low voltage double wall coil bobbin assembly and then winding high voltage wire in between the walls of the low voltage double wall coil bobbin assembly to form the high voltage-low voltage double wall coil bobbin assembly or (2) inserting the low voltage encapsulated stacked coil form into a single wall, single flanged coil bobbin, winding high voltage wire around the wall of the single wall, single flanged coil bobbin, and then placing a molded coil sleeve over the coil bobbin to form the high voltage-low voltage double wall coil bobbin assembly, (f) heat soaking the high voltage-low voltage coil bobbin assembly at 300° F. to 400° F. to form a heat soaked high voltage-low voltage double wall coil bobbin assembly, (g) encapsulating the inside of the heat soaked high voltage-low voltage double wall coil bobbin assembly with an electrical insulating material to form a first encapsulated high voltage-low voltage double wall coil bobbin assembly having a bottom part and a top part, (h) repeating steps (a) through (g) above to form a second and third encapsulated high voltage-low voltage double wall coil bobbin assembly, (i) assembling the "E" shaped core of the multi-phase transformer assembly by (1) setting the bottom part of the first, second, and third encapsulated high voltage-low double wall coil bobbin assemblies in a perpendicular fashion on the ends and center of a stacked laminate structure formed from trapezoidal or rectangular laminates having cut edges, (2) securing said stacked laminate structure to the coil bobbin assemblies with a securing device, and (3) repeating steps (i)(1) and (i)(2) on the top part of the first, second, and third coil bobbin assemblies to form an "E" core multi-phase transformer assembly, and (4) sealing any unencapsulated cut edges of the laminate stacked structures with a non-conductive film, (j) arranging the wiring in the "E" core multi-phase transformer assembly and attaching accessories to such transformers, (k) enclosing the accessories and wires of the "E" core multi-phase transformer assembly between two halves of a thermoplastic wire holder and then sealing the two halves of the thermoplastic wire holders together with a sealant, (l) heat soaking the "E" core multi-phase transformer assembly of step (k) at 300° F. to 400° F., and (m) encapsulating the heat soaked "E" core multi-phase transformer assembly from step (a) in a thermally conductive material.

2. The process of claim 1 wherein in step (h), only a second high voltage-low voltage double wall coil bobbin assembly is prepared and in step (i), one high voltage-low voltage double wall coil bobbin assembly is set perpendicular on each end of the stacked laminate structure, thereby forming a "C" core multi-phase transformer assembly.

3. A process for manufacturing a polymeric encapsulated single phase transformer having an "E" shaped core consisting essentially of the steps of (a) preparing a stacked laminate structure wherein the laminates are stamped in the shape of an "E", which "E" shaped laminate has a first end post, a center post, and a second end post, and wherein the laminates have cut edges, (b) winding low voltage wire on a coil form to form a low voltage coil form, (c) forming a high voltage-low voltage double wall coil bobbin assembly from the low voltage coil form by (1) inserting the low voltage coil form into a molded double wall coil bobbin to form a low voltage double wall coil bobbin assembly and then winding high voltage wire in between the walls of the low voltage double wall coil bobbin assembly to form the high voltage-low voltage double wall coil bobbin assembly or (2) inserting the low voltage coil form into a single wall, single flanged coil bobbin, winding high voltage wire around the wall of the single wall, single flanged coil bobbin, and then placing a molded coil sleeve over the coil bobbin to form the high voltage-low voltage double wall coil bobbin assembly, (d) heat soaking the high voltage-low voltage coil bobbin assembly at 300° F. to 400° F. to form a heat soaked high voltage-low voltage double wall coil bobbin assembly, (e) encapsulating the inside of the heat soaked high voltage-low voltage double wall coil bobbin assembly with an electrical insulating material to form an encapsulated high voltage-low voltage double wall coil bobbin assembly having a bottom part and a top part, (f) placing the bottom part of the encapsulated high voltage-low voltage double wall coil bobbin assembly over a post of the "E" shaped laminate stacked structure of step (a), (g) assembling a laminate stack structure from rectangular shaped laminates having cut edges and attaching the laminate stack structure to the top part of the high voltage-low voltage double wall coil bobbin assembly and the end posts of the "E" shaped laminate stack structure of step (f) to form an "E" core single phase transformer assembly, (h) arranging the wiring in the "E" core single phase transformer assembly and attaching accessories, (i) enclosing the accessories and wires of the "E" core single phase transformer assembly between two halves of a thermoplastic wire holder and then sealing the two halves of the thermoplastic wire holders together with a sealant, and then sealing any unencapsulated cut edges of the laminates with a non-conductive film, (j) heat soaking the "E" core single phase transformer assembly of step (i) at 300° F. to 400° F., and (k) encapsulating the heat soaked "E" core single phase transformer assembly from step (j) in a thermally conductive material.

4. A process for manufacturing a polymeric encapsulated multi-phase transformer having an "E" shaped core consisting essentially of the steps of (a) preparing a stacked laminate structure wherein the laminates are stamped in the shape of an "E", which "E" shaped laminate has a first end post, a center post, and a second end post, and said laminates have cut edges, (b) winding low voltage wire on a coil form to form a low voltage coil form, (c) forming a high voltage-low voltage double wall coil bobbin assembly from the low voltage coil form by (1) inserting the low voltage coil form into a molded double wall coil bobbin to form a low voltage double wall coil bobbin assembly and then winding high voltage wire in between the walls of the low voltage double wall coil bobbin assembly to form the high voltage-low voltage double wall coil bobbin assembly or (2) inserting the low voltage coil form into a single wall, single flanged coil bobbin, winding high voltage wire around the wall of the single wall, single flanged coil bobbin, and then placing a molded coil sleeve over the coil bobbin to form the high voltage-low voltage double wall coil bobbin assembly, (d) heat soaking the high voltage-low voltage coil bobbin assembly at 300° F. to 400° F. to form a heat soaked high voltage-low voltage double wall coil bobbin assembly, (e) encapsulating the inside of the heat soaked high voltage-low voltage double wall coil bobbin assembly with an electrical insulating material to form a first encapsulated high voltage-low voltage double wall coil bobbin assembly having a bottom part and a top part, (f) repeating steps (a)-(e) to form a second and a third encapsulated high voltage-low voltage double wall coil bobbin assembly, each of which has a bottom part and a top part, (g) placing the bottom part of the first encapsulated high voltage-low voltage double wall coil bobbin assembly over a post of the "E" shaped laminate stacked structure of step (a), and (h) repeating step (g) on the remaining posts with the second and third assemblies of step (f), (i) assembling a laminate stack structure from rectangular shaped laminates and attaching the laminate stack structure to the top part of the high voltage--low voltage double wall coil bobbin assemblies on the "E" shaped laminate stack structure of step (h) to form an "E" core multi-phase transformer assembly, (j) arranging the wiring in the "E" core multi-phase transformer assembly and attaching accessories, (k) enclosing the accessories and wires of the "E" core multi-phase transformer assembly between two halves of a thermoplastic wire holder, then sealing the two halves of the thermoplastic wire holders together with a sealant, and then sealing any unencapsulated cut edges of the laminates with a non-conductive film, (l) heat soaking the "E" core multi-phase transformer assembly of step (k) at 300° F. to 400° F., and (m) encapsulating the heat soaked "E" core multi-phase transformer assembly from step (1) in a thermally conductive material.

5. A process for manufacturing a polymeric encapsulated single or multi-phase transformer having a "C" shaped core consisting essentially of the steps of (a) (1) preparing a stacked laminate structure wherein the edges of the laminates are cut and wherein the laminates are in the shape of a "C", said "C" form having a first and a second post, or preparing a concentrically wound laminate structure by concentrically winding laminates and then cutting the resultant laminate structure in half, and (2) sealing the edges of the stacked laminate structure or the concentrically wound laminate structure with a non-conductive film, (b) winding low voltage wire on a coil form to form a low voltage coil form, (c) forming a high voltage-low voltage double wall coil bobbin assembly from the low voltage coil form by (1) inserting the low voltage coil form into a molded double wall coil bobbin to form a low voltage double wall coil bobbin assembly and then winding high voltage wire in between the walls of the low voltage double wall coil bobbin assembly to form the high voltage-low voltage double wall coil bobbin assembly or (2) inserting the low voltage coil form into a single wall, single flanged coil bobbin, winding high voltage wire around the wall of the single wall, single flanged coil bobbin, and then placing a molded coil sleeve over the coil bobbin to form the high voltage-low voltage double wall coil bobbin assembly, (d) heat soaking the high voltage-low voltage coil bobbin assembly at 300° F. to 400° F. to form a heat soaked high voltage-low voltage double wall coil bobbin assembly, (e) encapsulating the inside of the heat soaked high voltage-low voltage double wall coil bobbin assembly with an electrical insulating material to form a first encapsulated high voltage-low voltage double wall coil bobbin assembly having a bottom part and a top part, (f) repeating the processes of steps (b) to (e) to form a second encapsulated high voltage-low voltage coil bobbin assembly, (g) mounting the bottom part of the first encapsulated high voltage-low voltage coil bobbin assembly on the first post of the "C" stacked or concentrically wound laminate structure of step (a) and mounting the second high voltage-low voltage coil bobbin assembly on the second post of the "C" stacked or concentrically wound laminate structure of step (a), (h) assembling a laminate stack structure from rectangular shaped laminates and attaching the laminate stack structure to the top part of the first and second encapsulated high voltage-low voltage coil bobbin assembly to form a "C" core single or multi-phase transformer assembly, (i) arranging the wiring in the "C" core single or multi-phase transformer assembly and attaching accessories, (j) enclosing the accessories and wires of the "C" core single or multi-phase transformer assembly between two halves of a thermoplastic wire holder and then sealing the two halves of the thermoplastic wire holders together with a sealant, (k) heat soaking the "C" core single or multi-phase transformer assembly of step (j) at 300° F. to 400° F., and (l) encapsulating the heat soaked "C" core single phase transformer assembly from step (k) in a thermally conductive material.

6. A process for manufacturing a polymeric encapsulated toroidal shaped transformer consisting essentially of the steps of:

(a) preparing circumferential segments of a toroidal shaped core by (1) preparing a stacked laminate structure wherein the laminates are stamped into the shape of hollow cylinder wafers and stacked together to form circumferential segments of a toroidal core or (2) convolute winding a metal ribbon into a toroid shape and then separating the resultant metal toroid into circumferential segments of a toroidal core; and sealing the cut edges of the circumferential segments with a non-conductive film, (b) winding low voltage wire on a coil form to form a low voltage coil form assembly, (c) inserting the low voltage coil form assembly into a single wall, single flanged coil bobbin to form a low voltage coil bobbin assembly, (d) placing a coil sleeve over the low voltage coil bobbin assembly to form a low voltage coil bobbin-coil sleeve assembly, (e) winding high voltage wire around the outside of the coil sleeve of the low voltage coil bobbin-coil sleeve assembly to form a high voltage-low voltage coil bobbin-coil sleeve assembly, (f) heat soaking the high voltage-low voltage coil bobbin-coil sleeve assembly to form a heat soaked high voltage-low voltage coil bobbin-coil sleeve assembly, (g) encapsulating the inside of the heat soaked high voltage-low voltage coil bobbin-coil sleeve assembly with an electrically insulating material to form an insulated encapsulated high voltage-low voltage assembly, (h) placing one or more of the insulated encapsulated high voltage-low voltage assemblies over the circumferential segments of the toroidal core of step (a) to form assembled toroidal core segments, (i) bolting, bonding, strapping, or otherwise attaching the assembled toroidal core segments into a toroid to form a single or multi-phase toroidal transformer assembly, (j) arranging the wiring in the single or multi-phase toroidal transformer assembly in accordance with appropriate codes or standards, (k) attaching accessories to the single or multi-phase toroidal transformer assembly, (l) enclosing the accessories and wires of the single or multi-phase toroidal transformer assembly between two halves of a thermoplastic wire holder and then sealing the two halves of the thermoplastic wire holder together at the wire inlets and parting lines with a sealant, (m) heat soaking the single or multi-phase toroidal transformer assembly of step (l), and (n) encapsulating the heat soaked single or multi-phase transformer assembly of step (m) in a thermally conductive material.

7. The process of claims 1, 3, 4, 5, or 6 wherein the electrical insulating material is selected from the group consisting of 6,6-polyamide, 12,12-polyamide, polybutylene terephthalate, polyphenylene sulfide, and polyethylene terephthalate, and glass reinforced versions thereof.

8. The process of claims 1, 3, 4, 5, or 6 wherein the electrical insulating material is a glass reinforced polyethylene terephthalate thermoplastic molding resin.

9. The process of claims 1, 3, 4, 5, or 6 wherein the thermally conductive material is selected from thermoset and thermoplastic materials comprised of 10% to 70% by weight of a conductive material selected from the group consisting of metallic flake, thermally conductive powder, thermally conductive coke, and thermally conductive carbon fiber.

10. The process of claims 1, 3, 4, 5, or 6 wherein the thermally conductive material is selected from thermoset and thermoplastic materials comprised of 10% to 70% by weight of carbon fiber.

11. The process of claim 9 wherein the thermoplastic or thermoset material is selected from polyethylene terephthalate, polybutylene terephthalate, 6,6-polyamide, 12,12-polyamide, polypropylene, polyphenylene sulfide, and copolyetherester.

12. The process of claim 9 wherein the thermoplastic material is polyethylene terephthalate.

13. The process of claims 1, 3, 4, 5, or 6 wherein the non-conductive film is selected from electrical grade polyethylene terephthalate film and electrical grade polyimide film.

* * * * *